US006416622B2

(12) United States Patent
de Jong

(10) Patent No.: US 6,416,622 B2
(45) Date of Patent: Jul. 9, 2002

(54) HYBRID MULTISTAGE FORWARD CLEANER SYSTEM WITH FLOTATION CELL

(75) Inventor: Robert de Jong, Appleton, WI (US)

(73) Assignee: Georgia-Pacific Corporation, Atlanta, GA (US)

( * ) Notice: Subject to any disclaimer, the term of this patent is extended or adjusted under 35 U.S.C. 154(b) by 0 days.

(21) Appl. No.: 09/772,395

(22) Filed: Jan. 30, 2001

Related U.S. Application Data

(60) Provisional application No. 60/180,348, filed on Feb. 4, 2000.

(51) Int. Cl.[7] ..... D21D 5/24

(52) U.S. Cl. ..... 162/55; 162/4; 209/728; 241/28

(58) Field of Search ..... 162/4, 55, 57; 241/21, 24, 28, 29, 78; 209/162, 629

(56) References Cited

U.S. PATENT DOCUMENTS

| | | | | |
|---|---|---|---|---|
| 4,272,315 A | | 6/1981 | Espenmiller | 162/4 |
| 4,983,258 A | | 1/1991 | Maxham | 162/189 |
| 5,234,543 A | * | 8/1993 | Markham et al. | 162/5 |
| 5,240,621 A | | 8/1993 | Elonen et al. | 210/787 |
| 5,580,446 A | | 12/1996 | Markham | 210/202 |
| 5,693,222 A | | 12/1997 | Galvan et al. | 210/194 |
| 5,707,489 A | | 1/1998 | Grumbkow et al. | 162/4 |
| 5,882,475 A | * | 3/1999 | Vikio et al. | 162/4 |

FOREIGN PATENT DOCUMENTS

| | | | |
|---|---|---|---|
| DE | 31 16905 A1 | 11/1982 | D21C/5/02 |
| EP | 0 570 757 A1 | 11/1993 | D21B/1/02 |
| EP | 0 931 872 A1 | 7/1999 | D21B/1/32 |
| EP | 0 931 873 A1 | 7/1999 | D21B/1/32 |

* cited by examiner

*Primary Examiner*—Dean T. Nguyen
(74) *Attorney, Agent, or Firm*—Michael W. Ferrell

(57) ABSTRACT

A hybrid system for processing papermaking fibers includes a multistage array of forward cleaners coupled with a flotation cell which increases overall efficiency of the system. In a typical embodiment, a first rejects aqueous stream from a first stage bank of centrifugal cleaners is treated in a flotation cell before being fed to a second stage bank of centrifugal cleaners.

18 Claims, 5 Drawing Sheets

HYBRID MULTISTAGE FORWARD CLEANER SYSTEM WITH FLOTATION CELL

CLAIM FOR PRIORITY

This non-provisional application claims the benefit of the filing date of U.S. Provisional Patent Application Ser. No. 60/180,348, of the same title, filed Feb. 4, 2000.

TECHNICAL FIELD

The present invention relates generally to papermaking fiber processing and more particularly to a method and apparatus useful for cleaning secondary pulp by way of a multistage forward cleaner system with an integrated flotation cell which cooperates with the forward cleaners to boost efficiency of the system.

BACKGROUND

Processing of papermaking fibers to remove contaminants is well known in the art, including the use of forward cleaners and flotation cells. Such technology is used, for example, to treat secondary (recycle) fiber sources for re-use in paper products such as towel and tissue, paperboard, coated writing and printing papers and so forth. Following is a brief synopsis of some patents of general interest.

According to U.S. Pat. No. 4,272,315 to Espenmiller waste paper containing materials, e.g., commercial "waste paper", are treated for recovery of reusable paper therefrom by slushing in a pulper from which two fractions are continuously extracted—a first fraction through small holes, e.g. 3/16 inch in diameter, and a second fraction through substantially larger holes, e.g., 1 inch in diameter. The second fraction is screened, preferably after a centrifugal cleaning operation, in a screen having small perforations sized to accept only substantially defibered paper, and the accepts flow is mixed directly with the first extracted fraction. The reject flow from this screen is conducted, with or without an intermediate deflaking operation, to a tailing screen from which the accepts are recycled to the pulper and the rejects are eliminated from the system. Advantages of this method and system include the continuous elimination of plastic and other floating trash from the pulper, a high degree of essentially complete defibering in the pulper, and minimal recycling of adequately defibered stock.

U.S. Pat. No. 4,983,258 to Maxham discloses a process for the production of papermaking fiber or pulp from waste solids emanating from pulp and paper mills, particularly waste solids in process water streams containing fibrous solids that cannot be directly recycled by paper mill "saveall" devices, from pulp and paper mill process water streams conveyed by the sewerage system to wastewater treatment plant facilities, and from "sludge" emanating from the underflow of a primary clarifier or sedimentation basin at pulp and paper mill wastewater treatment facilities either before or after the "sludge" is thickened and dewatered. The said process comprises a defibering stage to release individual fibers from bundles, a screening stage to separate long fiber and debris from short fiber and clay, a centrifugal cleaning stage to separate debris from the long fiber, a bleaching stage to increase the brightness of the fiber, a dewatering stage to remove excess water from the pulp, a sedimentation stage to separate the short fiber-clay-debris from the defibering effluent which is substantially recycled, and a biological treatment process to remove dissolved organic materials from the excess water generated which can be either discharged from the process or recycled as process water.

U.S. Pat. No. 5,240,621 to Elonen et al. discloses a method of separating an aqueous solids containing suspension which includes (a) subjecting a first solids containing suspension to centrifugal forces so as to separate the suspension into a first gas containing flow, a second gas-free flow and a third flow; (b) feeding the third flow into a flotation cell having a bottom; (c) introducing air at the bottom of the flotation cell into the third flow for separating from the third flow a fourth partial flow; (d) withdrawing the air containing third flow after the separation of the fourth partial flow from the flotation cell; and (e) subjecting the third flow to the centrifugal forces of step (a). An apparatus for the separation of gas and lightweight material from a gas and lightweight material containing aqueous solids suspension is also described and includes a centrifugal pump for separating the gas and lightweight material from the solids suspension with a suspension inlet and an outlet for the lightweight material; a flotation cell for separating the lightweight material from a solids suspension; and a circulation loop connecting the outlet of the centrifugal pump, the flotation cell and the suspension inlet of the pump.

In U.S. Pat. No. 5,693,222 to Galvan et al. a dissolved gas flotation tank system is disclosed which is configured to provide educted gas or air into recirculated effluent fluid from the tank which includes a pump system which increases the dissolution rate of gas into the effluent fluid thereby eliminating the need for retention tanks and related equipment which adds to high equipment costs. The dissolved gas flotation tank system also provides a pre-contact chamber for assuring immediate and intimate contact between the suspended solids in an influent feed stream and the recirculated effluent fluid in which gas is dissolved, as well as flocculant when used, to produce a better agglomerate structure for improved flotation and separation. The dissolved gas flotation tank also provides an improved means of removing and processing float from the tank, and employs a dewatering system enhanced by the addition of chemicals or flocculants into the float removal system.

The disclosures of the foregoing patents are hereby incorporated for reference.

While flotation and separation technologies are fairly advanced, there is an ongoing need to increase overall fiber-cleaning system performance and to reduce the amount of waste and capital investment in the plant.

SUMMARY OF INVENTION

The present invention provides a hybrid system for processing papermaking fibers and includes a multistage array of forward cleaners coupled with a flotation cell which increases overall efficiency of the system. In a typical embodiment, a first rejects aqueous stream from a first stage bank of centrifugal cleaners is treated in a flotation cell before being fed to a second stage bank of centrifugal cleaners.

One advantage of feeding the second accepts stream forward is that it does not have to be returned to the first bank of cleaners for re-cleaning. This reduces the size of the first bank of cleaners or allows an existing installation to operate at a lower consistency. (The cleaners operate more efficiently at a low consistency of 0.5% than at 0.8 or 1%). Another advantage is that the flotation cell operates at greater than 60% efficiency on removing hydrophobic contaminants from the first cleaner rejects, while another cleaner stage removes less than 50% of the hydrophobic contaminants. As a result a large quantity of hydrophobic contaminants are removed in the flotation stage, which makes the remaining cleaner stages work more efficiently with less good fiber loss.

Investigation showed that the number of hydrophobic contaminants in the second cleaner accepts after the flotation stage was lower than the number of hydrophobic contaminants in the first cleaner accepts. Without the flotation stage the number of hydrophobic contaminants in the second accepts is much higher than the first accepts, so that the second accepts have to be returned to the first bank of cleaners for more cleaning.

As will be appreciated from the discussion which follows, the size and cost of a flotation stage for treating secondary fiber can be reduced by up to 75% if it is installed in centrifugal cleaner system as compared to a full scale treatment of the stock by flotation. The centrifugal cleaner system modeling indicates a 34% reduction in ink speck area of total centrifugal cleaner system accepts by removing ink specks from the first stage rejects with 80% efficiency in a flotation stagc and then feeding the flotation accepts forward after centrifugal cleaning of the second stage. (24% reduction if second stage rejects are treated in a similar manner). The ability to feed the centrifugal cleaner rejects forward (after the flotation stage and additional centrifugal cleaning in the next stage) reduces the stock consistency in the first stage, thereby improving the efficiency of He first stage. The capacity of the system is also increased by feeding the second stage centrifugal cleaner accepts forward. The other centrifugal cleaner ages can also be operated more efficiently since more than 50% of the ink in the first stage centrifugal cleaner rejects has been removed in the flotation stage. When the centrifugal cleaner accepts are thickened in a press, a large amount of ink ends up in the pressate. This ink can also be removed by using the ink-laden pressate as dilution water for the centrifugal cleaner rejects going to the flotation stage.

A conventional centrifugal cleaner system (as shown in FIG. 1) normally consists of several stages, whereby the rejects of each centrifugal cleaner stage are diluted for cleaning in the next stage and the centrifugal cleaner accepts are fed backwards to the feed of the previous stage. The ink speck removal efficiency of the centrifugal cleaner is usually much less than 50% on toner inks in office waste paper. As a result the total centrifugal cleaner system ink speck removal efficiency can drop to 30% or less on a furnish containing a large proportion of office waste.

By sending the first or second stage centrifugal cleaner rejects to a flotation stage (as shown in FIG. 2) it is possible to remove a much higher percentage of the ink specks in office waste. (It was possible to obtain 80% removal of ink specks during a pilot plant trial with a flotation cell operated on second stage centrifugal cleaner rejects.) If the accepts of the flotation cell are cleaned in the next centrifugal cleaner stage, the centrifugal cleaner accepts from that stage can then be fed forward to the thickener. Sending centrifugal cleaner accepts forward reduces the load and improves the efficiency of the previous centrifugal cleaner stage.

The present invention is particularly useful in connection with removing stickies from the recycle fiber product stream; likewise, it is believed pitch removal is enhanced. Stickies are generally a diverse mixture of polymeric organic materials which can stick on wires, felts or other parts of paper machines, or show on the sheet as "dirt spots". The sources of stickies may be pressure-sensitive adhesives, hot melts, waxes, latexes, binders for coatings, wet strength resins, or any of a multitude of additives that might be contained in recycled paper. The term "pitch" normally refers to deposits composed of organic compounds which are derived form natural wood extractives, their salts, coating binders, sizing agents, and defoaming chemicals existing in the pulp. Although there are some discrete characteristics, there are common characteristics between stickies and pitch, such as hydrophobicity, low surface energy, deformability, tackiness, and the potential to cause problems with deposition, quality, and efficiency in the process. Indeed, it is possible with the present invention to reduce stickies by 50%, 80% or even more by employing a flotation cell in a multistage forward cleaner system as hereinafter described in detail.

The rejects from the flotation stage are so full of ink and ash that they can be rejected without any further treatment.

There is provided in one aspect of the present invention, a method of processing papermaking fibers with a multistage array of forward cleaners including a plurality of centrifugal cleaners configured to generate accepts streams and rejects streams which concentrate heavy waste, the method including (a) feeding a first aqueous feed stream including papermaking fibers to a first stage bank of centrifugal cleaners of the multistage array; (b) generating a first accepts aqueous stream and a first rejects aqueous stream in the first stage bank of centrifugal cleaners, the first aqueous rejects stream being enriched in heavy waste with respect to said first aqueous feed stream; (c) supplying the first rejects aqueous stream to a flotation stage; (d) treating the first rejects aqueous stream in the flotation stage to remove hydrophobic waste from the first aqueous rejects stream and produce an intermediate aqueous purified feed stream; and (e) feeding the aqueous purified intermediate feed stream to a second stage bank of centrifugal cleaners of the multistage array, the second centrifugal cleaner being configured to generate a second accepts aqueous stream, wherein the second rejects aqueous stream is enriched in heavy waste with respect to said aqueous purified intermediate feed stream. The method may further include feeding the first accepts aqueous stream and said second accepts aqueous stream to another cleaning device or a thickening device. Suitable additional cleaning devices include screening devices, reverse cleaners and the like. In a preferred embodiment, the first aqueous feed stream comprises a preliminary accepts stream generated by way of a preliminary bank of centrifugal cleaners dividing a preliminary feed stream into a preliminary accepts stream and a preliminary rejects stream. A preferred method may include feeding the preliminary rejects stream to the flotation stage and treating the preliminary rejects stream along with the first rejects aqueous stream to remove hydrophobic waste therefrom whereby the aqueous purified intermediate stream includes treated components from both the preliminary rejects stream and the first rejects aqueous stream.

In other preferred embodiments, the process may include feeding the second rejects aqueous stream to a third centrifugal cleaner operative to generate a third accepts aqueous stream and a third rejects aqueous stream.

Preferably, the multistage array of forward cleaners comprises at least 3 banks of centrifugal cleaners, and still more preferably, the multistage array of forward cleaners comprises at least 5 banks of centrifugal cleaners. The first aqueous feed stream generally has a consistency of from about 0.3% to about 0.9%, whereas the first aqueous stream more typically has a consistency of from about 0.4% to about 0.7%. The hydrophobic waste removed from the first aqueous stream by the flotation stage often includes an ink and stickies composition, toner ink compositions being typical in office waste and stickies compositions frequently being obtained from pressure sensitive adhesives in office waste.

In another aspect of the invention there is provided a hybrid apparatus for processing papermaking fibers with a multistage array of forward cleaners including (a) a first bank of centrifugal cleaners configured to generate a first accepts stream and a first rejects stream upon operating on a first aqueous feed stream, the first rejects stream being enriched with respect to heavy hydrophobic contaminants with respect to the first aqueous feed stream; (b) a flotation cell connected to the first bank of centrifugal cleaners so as to receive the first rejects stream and adapted to remove hydrophobic contaminants such as ink, stickies and the like from the first rejects stream, the flotation cell being constructed and arranged so as to generate a flotation rejects stream and a flotation accepts stream which is purified with respect to hydrophobic contaminants in said first rejects stream; and (c) a second bank of centrifugal cleaners coupled to the flotation cell so as to receive the flotation accepts stream as a second feed stream, the second bank of centrifugal cleaners being likewise configured to generate an accepts stream hereinafter referred to as a second accepts stream and a second rejects stream respectively. In a preferred embodiment, a preliminary bank of centrifugal cleaners is provided upstream of the first bank of centrifugal cleaners and coupled thereto whereby the accepts stream of the preliminary bank of centrifugal cleaners is fed to the first bank of centrifugal cleaners. The banks of centrifugal cleaners are typically hydrocyclone type cleaners.

Unless otherwise indicated, terminology appearing herein is given its ordinary meaning; %, percent or the like refers, for example, to weight percent and "consistency" refers to weight percent fiber or solids as that term is used in papermaking.

BRIEF DESCRIPTION OF DRAWINGS

The invention is described in detail below with reference to numerous examples and the appended Figures wherein like numbers designate similar parts throughout and wherein.

DETAILED DESCRIPTION

Figure 1:
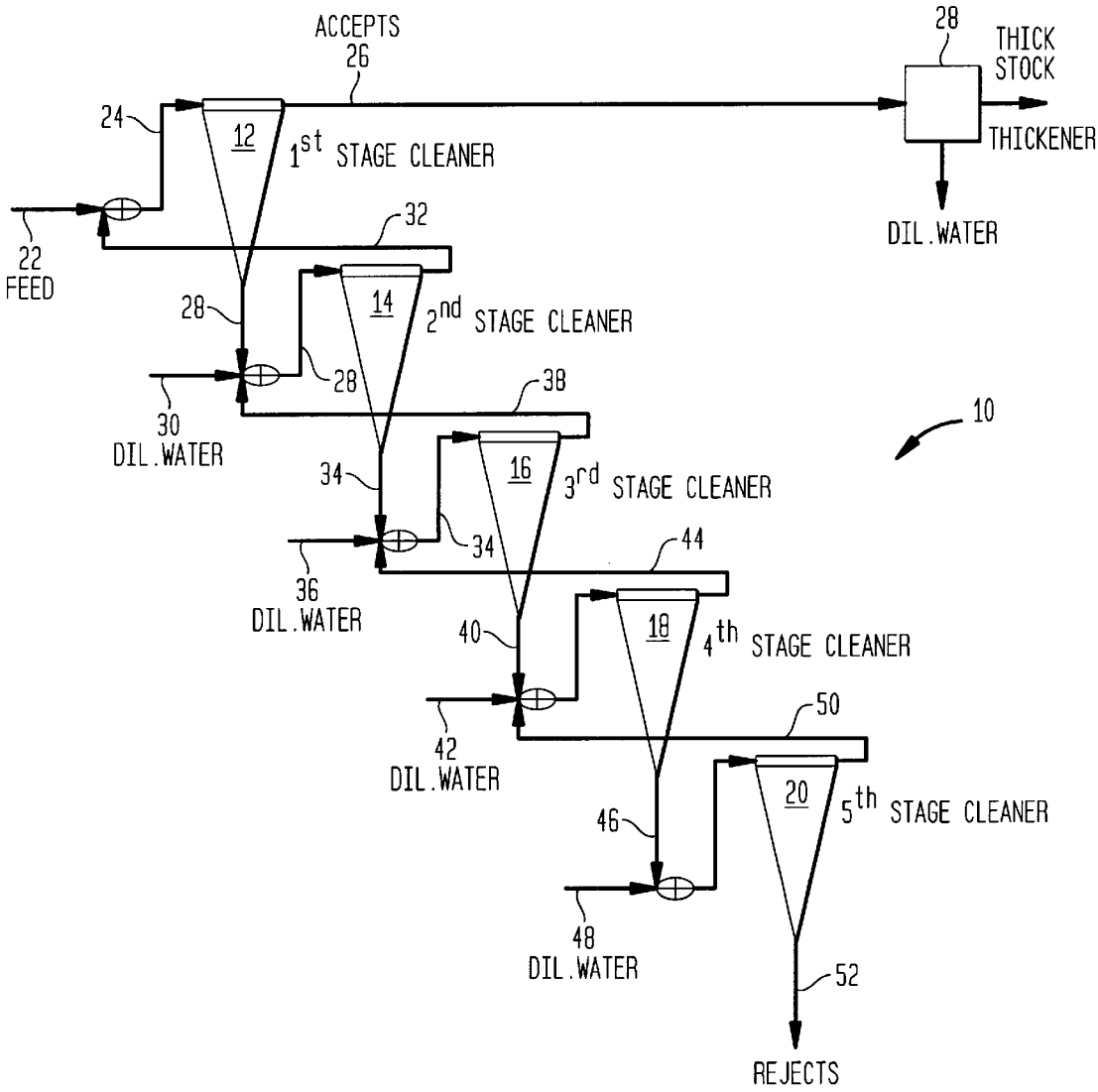
FIG. 1 is a schematic of a conventional multistage forward centrifugal cleaner system wherein each bank of cleaners are designated by a conical element.

The invention is described in detail below for purposes of illustration and exemplification only. Such explanation of particular embodiments in no way limits the scope of the invention which is defined in the appended claims. Referring to FIG. 1, there is shown a conventional forward cleaner system 10 of the type employed at a paper mill, for instance, as part of the cleaning process for processing secondary pulp into paper products. System 10 has five stages 12, 14, 16, 18 and 20 of banks of centrifugal cleaners interconnected in the manner shown. Such connections may include suitable piping, mixing tanks, holding vessels and the like (not shown) as may be convenient for operating the system. Pulp is fed at low consistency to the system at 22 to the first bank of cleaners 12 through inlet 24 and centrifugally treated in the first stage by a bank of hydrocyclones, for example, such that the accepts are fed forward at 26 to a thickener (or another cleaning device) at 28 whereas the rejects, concentrating the heavy, hydrophobic waste in the system are fed to second stage 14 at 28 for further treatment in a second stage made up of a second bank of centrifugal cleaners 14. Diluent water is added to the rejects stream from the first stage as indicated at 30 in an amount suitable for the particular system or operating conditions. Stream 28 (first stage rejects) is thus fed to the second stage cleaners whereupon bank 14 of cleaners generates an accepts stream 32 and a rejects stream 34. Stream 32 is a recycled to the feed 22 and makes up a portion of the material fed to the first stage bank of cleaners 12. The first bank of cleaners may be made up of 50 or more hydrocyclones depending on capacity and performance desired. Subsequent stages will each contain fewer cleaners than the previous stage depending upon the amount of rejects, until the final stage contains less than 10 cleaners.

Stream 34 is again enriched with respect to heavy components (with respect to stream 32) and is fed to the third stage 16 bank of cleaners for further processing. Diluent water may again be added at 36 if so desired to stream 34. Stage 16 generates another accepts stream 38 which is fed back to the second stage (stream 28) and another rejects stream 40 enriched in heavy hydrophobic components.

In like fashion, stream 40 is fed to the fourth stage 18 bank of cleaners at 42 where diluent water may again be added. The fourth stage generates another accepts stream 44 and another rejects stream 46. These streams have the rejects/accepts characteristics noted above.

Stream 46 is fed to yet another stage 20 of forward cleaners at 48 wherein stream 46 is divided into an accepts stream 50 and a rejects stream 52 as indicated on the diagram. Accepts stream 50 is recycled to the fourth stage as shown and rejects stream 52 is discarded or further processed if so desired. There is thus described a conventional forward cleaner system utilizing centrifugal cleaners in cascaded/refluxing fashion to concentrate the waste material and purify the pulp which is fed forward at a papermaking process to a thickening device or a cleaning device such as screens or a reverse cleaner.

In accordance with the present invention, a flotation stage is advantageously integrated into a multistage forward cleaner system to remove hydrophobic material and increase the cleaning efficiency. Flotation utilizes the phenomenon that the minerals which are present in the ground ore can partially be wetted, i.e., they are hydrophilic, while other parts of the minerals are hydrophobic. Hydrophobic particles have a clear affinity to air. Accordingly, finely distributed air is introduced into the solid-water-mixture so that the air will attach to the hydrophobic particles causing them to rise to the surface of the mixture or suspension. The hydrophobic particles, such as valuable minerals or the above-mentioned contaminants present in repulped stock suspensions, collect as froth at the surface of the suspension and are skimmed off with a suitable means such as a paddle or weir. The hydrophilic particles of the ore or stock suspension remain in the flotation vat. It is also possible to separate two or more useful minerals selectively by the flotation method, for example, in the separation of sulfidic lead/zinc ores. For controlling the surface properties of the minerals small amounts of additives of chemical agents are introduced such as, for example, foaming agents which will help to stabilize the air bubbles, so-called collecting agents which actually cause the hydrophobic effect and prepare the mineral particles for attachment to the air bubbles, and floating agents which temporarily impart hydrophilic properties to the hydrophobic minerals and later return the hydrophobic properties for selective flotation, as mentioned above. The latter are generally inorganic compounds, mostly salts, while the collectors are mostly synthetic organic compounds, and the foaming agents are oily or soapy chemicals such as fatty acid soap.

The apparatus of the present invention may utilize a variety of readily available components. The centrifugal cleaners, for example, are available from Ahlstrom (Noormarkku, Finland) or Celleco (Model 270 series) (Lawrenceville, Ga. USA) and are arranged in banks as shown in FIGS. 2–5. The flotation stage, which may be multiple cells, are likewise readily available from Comer SpA (Vicenza, Italy). Comer Cybercel® models FCB1, FCB3 and FCB4 are suitable as discussed further herein.

Figure 2:
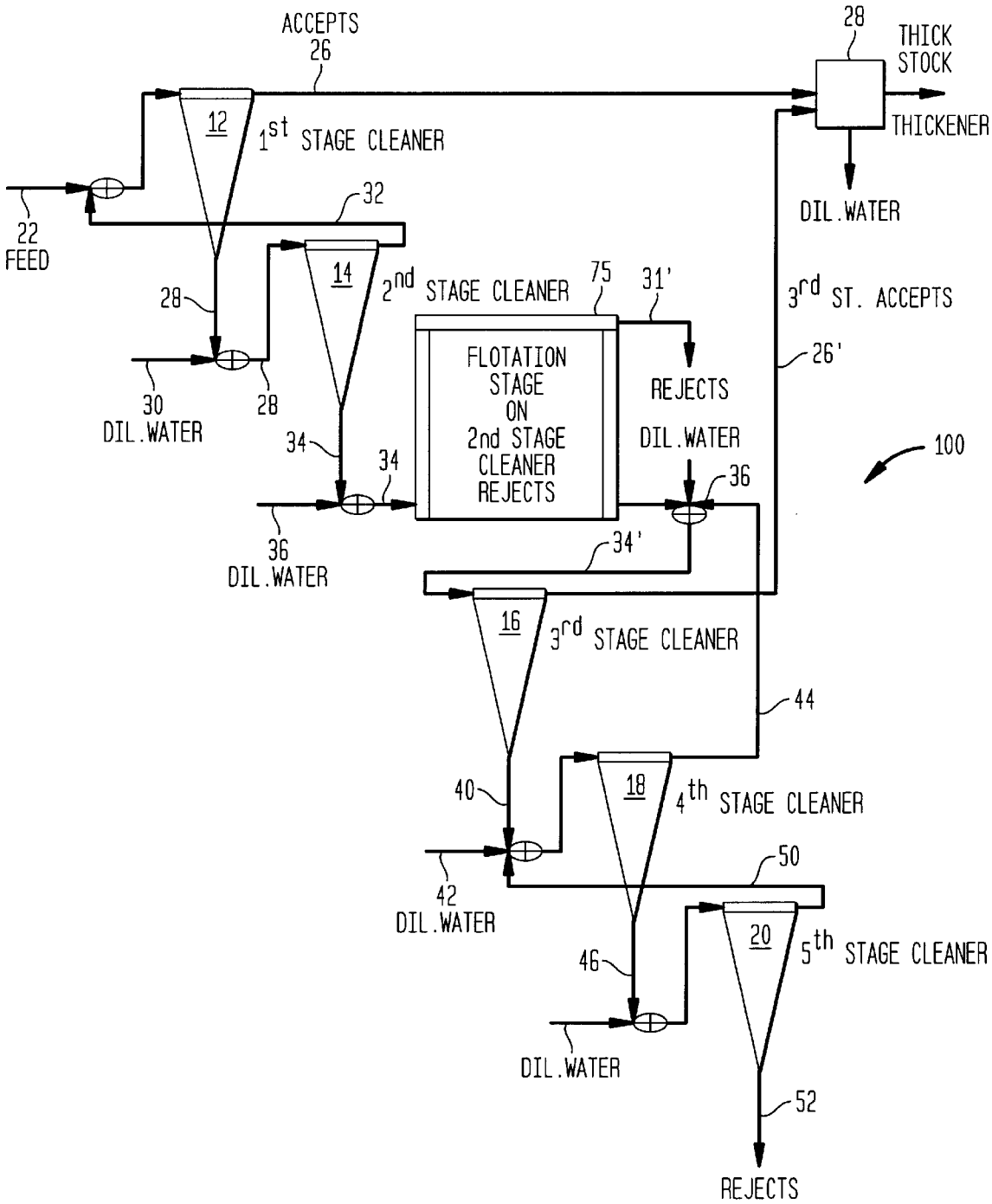
FIG. 2 is a schematic diagram of a hybrid multistage forward cleaner/flotation apparatus and process of the present invention, wherein a flotation stage is provided to treat the second stage rejects stream.

There is illustrated in FIG. 2 an apparatus 100 and method in accordance with the present invention. Apparatus 100 operates similarly to apparatus 10 in FIG. 1. Like parts are given like numbers for purposes of brevity and only differences noted from the discussion above. The system 100 of FIG. 2 operates as described in connection with system 10 of FIG. 1 and is so numbered in the drawing except that system 100 has a flotation stage 75 for treating the rejects stream 34 of second stage cleaner 14. Diluent water may be added at 36 as before, and hereafter, stream 34 is treated in the flotation stage to remove hydrophobic material. The accepts from the flotation stage, that is purified as shown by removing hydrophobic waste from stream 34, is then fed in stream 34' to third stage cleaner 16. Instead of refluxing the accepts from the third stage back to the second stage, the accepts material is fed forward in a product stream 26' for downstream processing. The hydrophobic rejects (31') from flotation stage (75) are removed from system 100.

Figure 3:
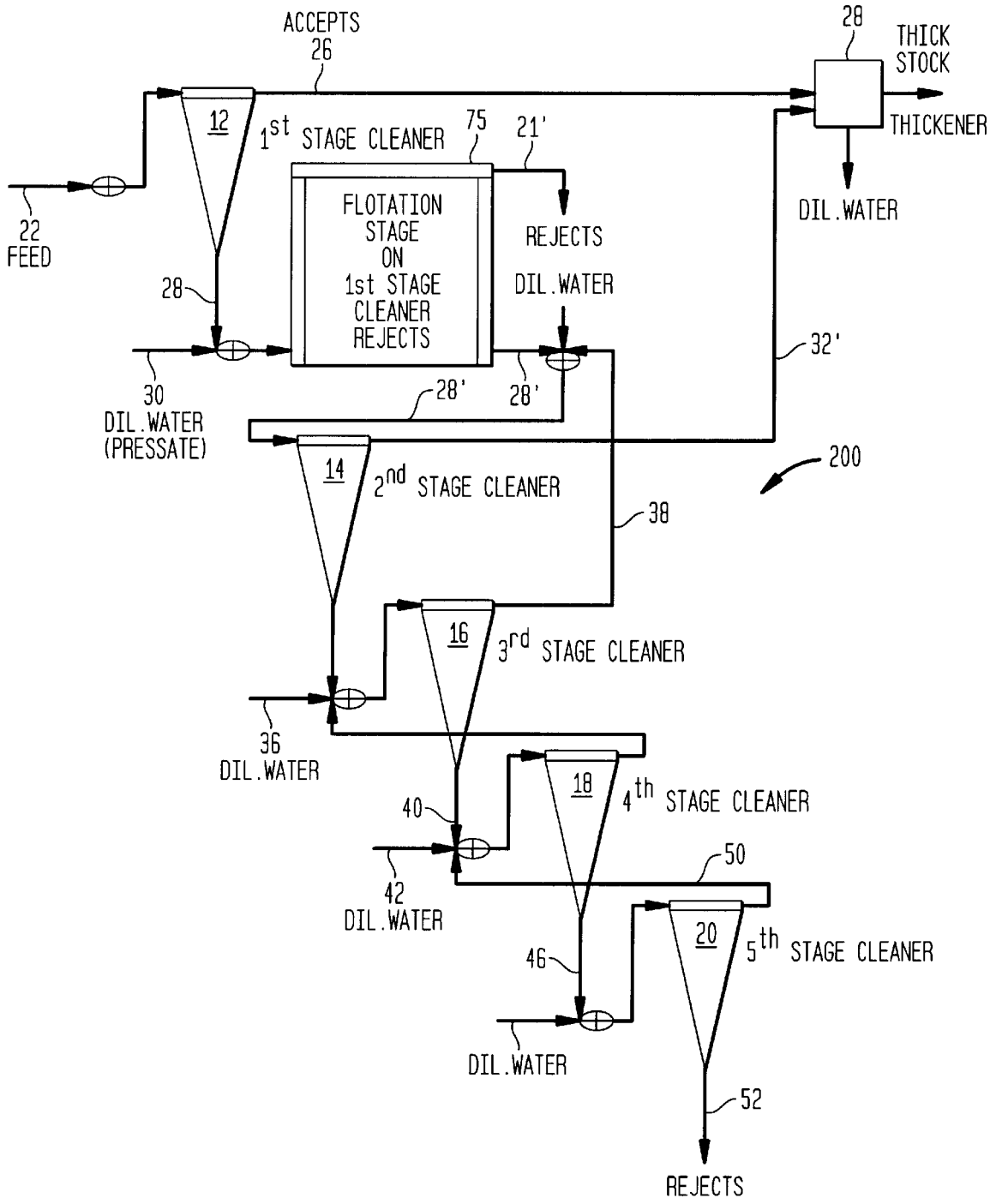
FIG. 3 is a schematic diagram of a hybrid multistage forward cleaner/flotation apparatus and process of the present invention wherein a flotation stage is provided to treat the first stage rejects stream.

In FIG. 3 there is illustrated another apparatus 200 and method of the present invention. Here again similar functioning parts are numbered as in FIGS. 1 and 2, the discussion of which is incorporated by reference here. Apparatus 200 of FIG. 3 differs from apparatus 10 of FIG. 1 in that a flotation stage 75 is added to treat the first stage rejects stream 28 to remove hydrophilic waste to produce an intermediate purified stream 28' which is fed to the second stage bank of cleaners 14. Bank 14 generates a purified accepts stream 32' which is fed forward to the thickening or other device 28 along with stream 26. The hydrophobic rejects (21') from flotation stage (75) are removed from system 200.

Figure 4:
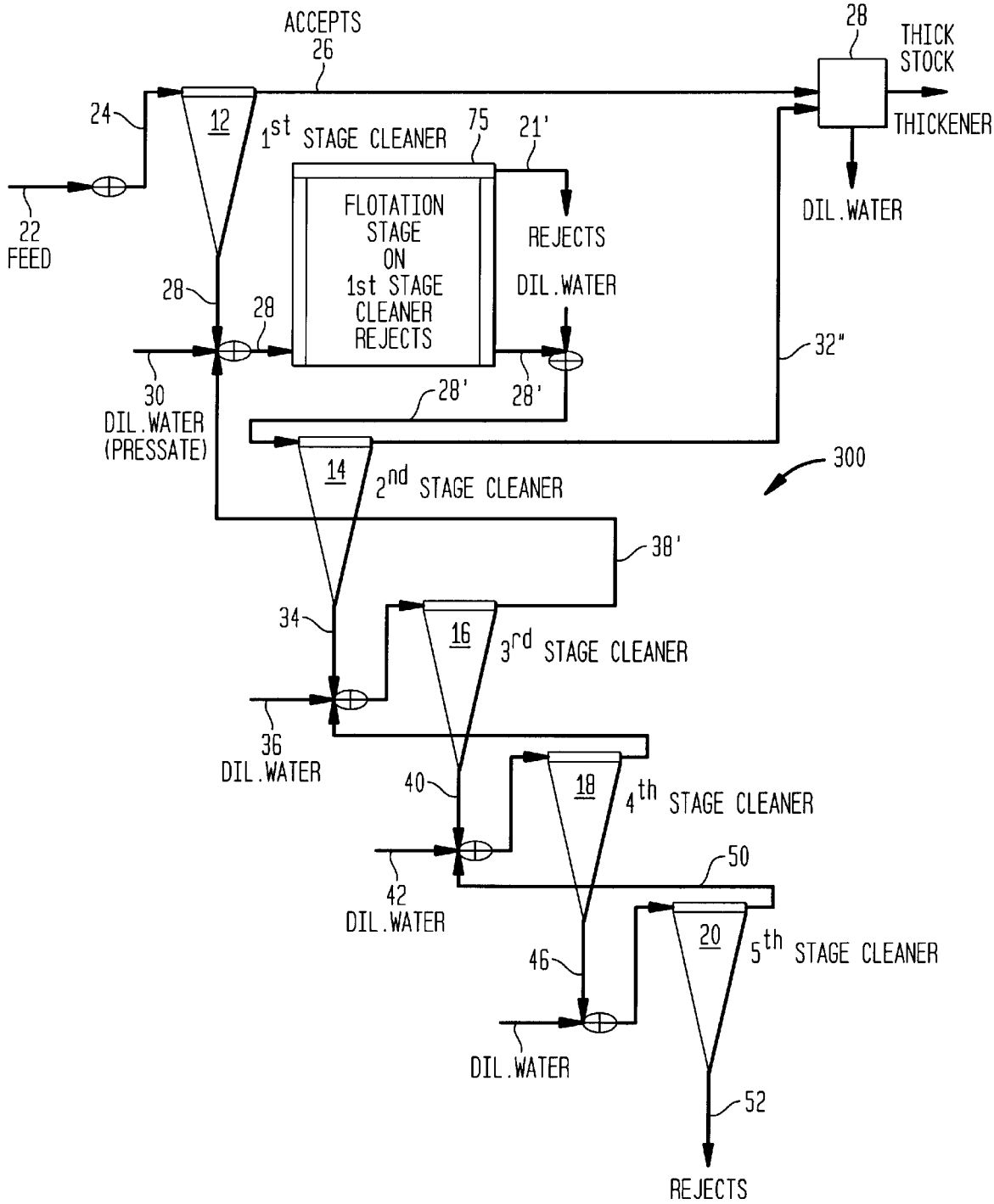
FIG. 4 is a schematic diagram of a hybrid multistage forward cleaner/flotation apparatus and process of the present invention wherein a flotation stage is provided to treat the first stage rejects and third stage accepts.
Figure 5:
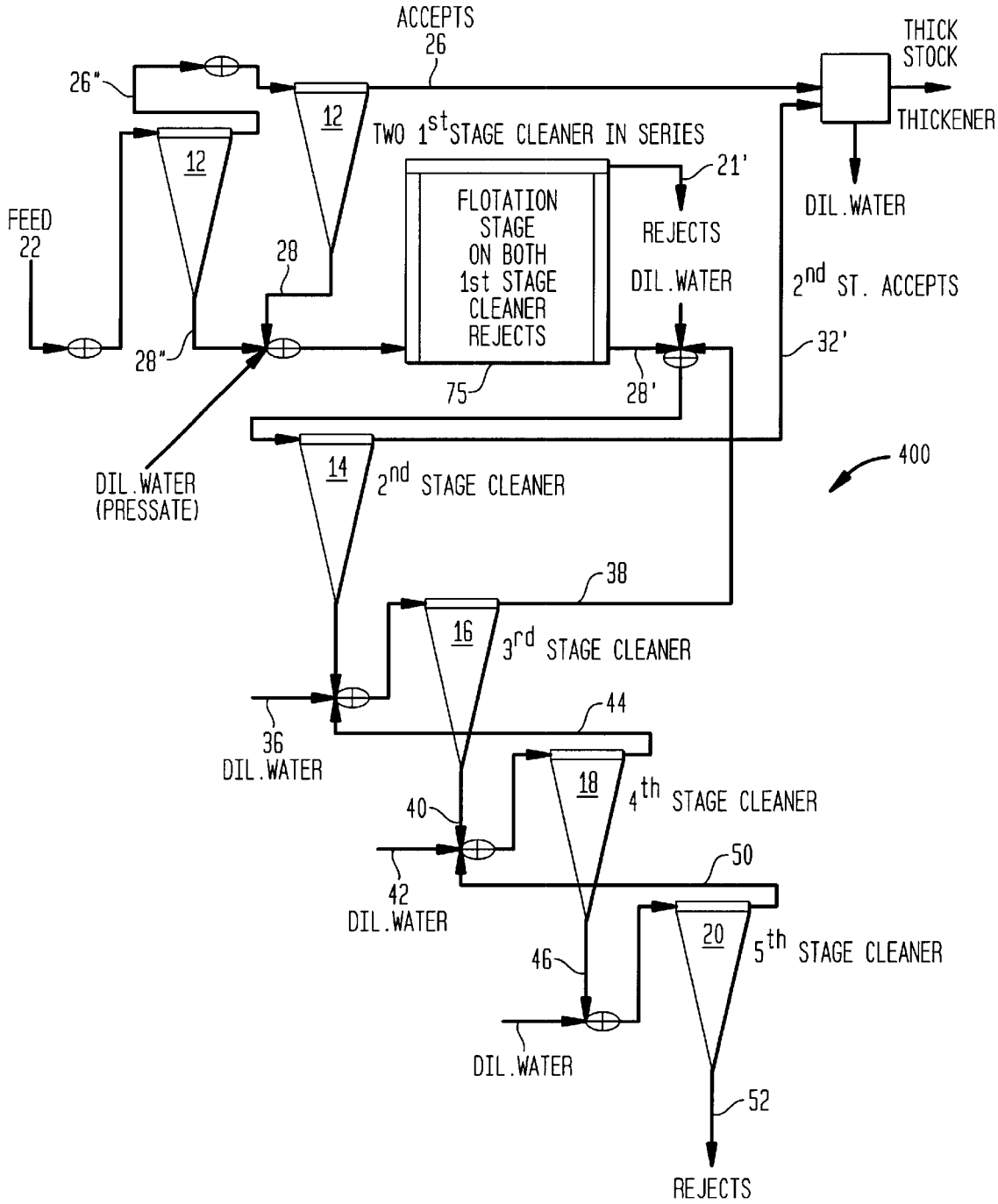
FIG. 5 is a schematic diagram illustrating an apparatus and process of the present invention wherein the hybrid system has dual forward cleaner banks in series and the rejects stream from both of the forward cleaner banks are provided to a flotation cell.

In FIGS. 4 and 5 there are illustrated alternate embodiments of the present invention. Like components are numbered as in FIGS. 1–3 above, the discussion of which is incorporated by reference. In the apparatus 300 of FIG. 4, there is provided a flotation cell 75 which treats rejects stream 28 from the first centrifugal cleaning stage along with accepts stream 38' from the third centrifugal cleaning stage. Stream 38' is combined with rejects stream 28 and fed to the flotation stage where hydrophobic material is removed and an intermediate purified stream 28' is produced. Stream 28' is fed to the second stage 14 of centrifugal cleaners. The accepts stream from stage 14 is fed forward as stream 32" and combined with stream 26 in thickening device 28. The hydrophobic rejects (21') from flotation stage (75) are removed from system 300.

Apparatus 400 of FIG. 5 resembles apparatus 200 of FIG. 3 except that there is provided a preliminary stage 12' of centrifugal cleaners, the accepts stream 26" of which is utilized as the feed to stage 12. Rejects stream 28" of stage 12' is combined with rejects stream 28 of stage 12 and fed to flotation stage 75. Accepts stream 32' of the second stage cleaners is fed forward with accepts stream 26 of stage 12. The hydrophobic rejects (21') from flotation stage (75) are removed from system 400.

EXAMPLE

Pilot plant trials showed that flotation cells such as the Comer Cybercel® can successfully deink secondary centrifugal cleaner rejects, with better results obtained if the consistency is kept close to 0.6%. Consistency refers to weight percent fiber or associated solids such as ash unless the context indicates otherwise. Results on 42% office waste (Grade A) and 100% office waste (Grade B) are shown in Table 1.

TABLE 1

Pilot Plant Results for Brightness Gain, Dirt + Ash Removal Efficiency on Grades A and B at Halsey and Results Used in Simulation Models

| Grade: | A | B | Model |
|---|---|---|---|
| Consistency: | 0.69% | 0.90% | 0.62% |
| Brightness Gain: | 18.5% | 5.3% | |
| Dirt Removal: | 77–89% | 65–87% | 80% |
| Ash removal: | 63% | 64% | 64% |

A simulation model was used to calculate the impact of a Comer Cybercel® flotation cell to deink forward cleaner rejects on solids loss, ash removal and on removal efficiency of mid-dirt (>150 microns) from a $1^{st}$ washer to the deinked pulp (while running grade B at 336 tpd at the $1^{st}$ washer):

TABLE 2

Impact of Flotation Cell on Solids Loss, Ash Loss, and Mid-dirt Removal Efficiency (according to the Simulation Model for 6 different configurations on Grade B)

| Example | | Solids loss | Ash loss | Mid-dirt Eff. |
|---|---|---|---|---|
| 1 | No Flotation cell | 8.9 tpd | 0.8 tpd | 96.1% |
| 2 | Flotation cell on $2^{nd}$ stage Rejects | 2.7 tpd | 0.9 tpd | 97.0% |
| 3 | Flotation cell on $1^{st}$ stage Rejects | 6.7 tpd | 1.9 tpd | 97.4% |
| 4 | As 3 with 50% eff. in $1^{st}$ stage | 6.7 tpd | 1.9 tpd | 97.7% |
| 5 | Flotation cell on $1^{st}$ stage Rejects + $3^{rd}$ stage accepts, 44% eff. in $1^{st}$ stage | 8.9 tpd | 1.9 tpd | 97.7% |
| 6 | Flotation cell on two $1^{st}$ stages | 11.8 tpd | 2.8 tpd | 98.5% |

The following indicators were used to evaluate the performance of the pilot plant:

feed consistency.

brightness gain of handsheets from accepts compared to feed.

Dirt removal efficiency of small dirt (<150 microns), mid-dirt (>150 microns) and large dirt (>200 microns).

Ash removal efficiency.

The results in Table 3 below for examples 7–14 (duplicate runs) show that even at 0.90% feed consistency it was possible to obtain 5.3% points brightness gain, 73% mid-dirt removal efficiency and 64% ash removal on Grade B. Operating the flotation cell at 0.69% consistency on Grade A, it was possible to obtain 8.1% points brightness gain, 79% mid-dirt removal efficiency and 63% ash removal.

TABLE 3

Comer Pilot Plant Results on 2nd stage Cleaner Rejects

| Example | Anal. | Cons. % | Feed Ash % | Brightness Gain | Dirt + Ash Removal % Small | Mid | Large | Ash | Comments |
|---|---|---|---|---|---|---|---|---|---|
| Grade B | | | | | | | | | |
| 7 | 1 | 0.86 | | 3.3 | 88 | 71 | 64 | | |
| | 2 | | 4.4% | 5.8 | 87 | 74 | 65 | 59 | Accepts = 90% > 200 m. |
| 8 | 1 | 0.88 | | 5.4 | 87 | 74 | 67 | | |
| | 2 | | 3.9% | 4.6 | 86 | 69 | 57 | 52 | Accepts = 99% > 200 m. |
| 9 | 1 | 0.88 | | 6.3 | 88 | 78 | 74 | | |
| | 2 | | 5.9% | 5.0 | 87 | 73 | 66 | 68 | |
| 10 | 1 | 0.98 | | 5.9 | 89 | 74 | 61 | | |
| | | | 3.8% | 5.7 | 86 | 69 | 63 | 77 | |
| | Average | 0.90 | 4.5% | 5.3 | 87 | 73 | 65 | 64 | |
| Grade A | | | | | | | | | |
| 11 | 1 | 0.53 | | 7.3 | — | — | — | | |
| | 2 | | 15.9% | 9.4 | 92 | 78 | 72 | | Accepts = 95% > 200 m. |
| 12 | 1 | 0.83 | | 4.2 | 88 | 70 | 60 | 70 | |
| | 2 | | 17.8% | 8.2 | 87 | 70 | 64 | | Accepts = 90% > 200 m. |
| 13 | 1 | 0.70 | | 8.6 | 89 | 88 | 92 | 53 | |
| | 2 | | 16.5% | 8.0 | 89 | 80 | 80 | | Accepts = 74% > 200 m. |
| 14 | 1 | — | | 8.7 | 91 | 85 | 87 | 67 | |
| | 2 | | 23.8% | 10.4 | 89 | 85 | 85 | | |
| | Average | 0.69 | 18.5% | 8.1 | 89 | 79 | 77 | 63 | |

The effect of incorporating a flotation stage in accordance with the present invention into a multistage forward cleaner system was evaluated with a computer model with respect to the systems illustrated in FIGS. 1–5. Results are summarized in the tables below. DIP refers to deinked pulp and DRE refers to dirt removal efficiency.

TABLE 4

System of FIG. 1 - Conventional Multi-Stage Cleaner System

SUMMARY

| | | | Flow gpm | Cons. % | STPD | Ash % | Ash STPD | Dirt > 150 ppm/1.2 g | Dirt > 150 $m^2$/day |
|---|---|---|---|---|---|---|---|---|---|
| Washer | | Thick Stock | 540 | 10.37 | 335.7 | 2.53 | 8.5 | 720 | 3310 |
| | | DWw | 4272 | 0.03 | 7.7 | 7 | 0.5 | 1504 | 158 |
| Gyro | | Accept | 4812 | 1.19 | 343.4 | 2.63 | 9.0 | 738 | 3468 |
| Gyro | | Accept | 4812 | 1.19 | 343.4 | 2.49 | 8.55 | 738 | 3468 |
| Dil. Water | | | 4741 | 0.03 | 8.5 | 7.00 | 0.60 | 1504 | 176 |
| | Total in | | 9553 | | 351.9 | | 9.15 | | 3644 |
| 1st Stage Cleaner | | Accept | 9492 | 0.60 | 343.0 | 2.43 | 8.34 | 596 | 2798 |
| | Total out | Accept | 9492 | | 343.0 | | 8.34 | 596 | 2798 |
| | Diff. | In-out | 60 | | 8.9 | | 0.8 | | 846 |
| 5th Stage Cleaner | | Rejects | 60 | 2.46 | 8.9 | 9.04 | 0.80 | 6957 | 847 |
| | Total | Rejects | 60 | | 8.9 | | 0.8 | | 847 |
| | | Cleaner to Press DRE: | | | | | | 30.0% DRE | |
| Dil. Water | | Out | 9334 | 0.03 | 16.8 | | | | |
| Press | | Out | 158.5 | 35.1 | 326.2 | 1.9 | 6.2 | 417 | 1863 |
| | | Press to DIP DRE: | | | | | | 93.3% DRE | |
| DIP | | | | | | | | 28 | |
| PROCESS | | WASHER - DIP | | | | | | 96.1% DRE | |

TABLE 5

System of FIG. 2 - Multi-Stage Cleaner System with Flotation Cell on 2nd Stage Rejects

SUMMARY

| | | | Flow gpm | Cons. % | STPD | Ash % | Ash STPD | Dirt > 150 ppm/1.2 g | Dirt > 150 $m^2$/day |
|---|---|---|---|---|---|---|---|---|---|
| Washer | | Thick Stock | 540 | 10.37 | 335.7 | 2.53 | 8.5 | 720 | 3310 |
| | | DWw | 4272 | 0.03 | 7.7 | 0.7 | 0.1 | 150.4 | 16 |
| Gyro | | Accept | 4812 | 1.19 | 343.4 | 2.49 | 8.5 | 708 | 3326 |
| Gyro | | Accept | 4812 | 1.19 | 343.4 | 2.49 | 8.55 | 708 | 3327 |
| Dil. Water | | | 5666 | 0.03 | 10.2 | 0.70 | 0.07 | 150 | 21 |
| | Total in | | 10478 | | 353.5 | | 8.62 | | 3348 |
| 1st Stage Cleaner | | Accept | 9492 | 0.57 | 327.0 | 2.25 | 7.34 | 461 | 2063 |
| 3rd Stage Cleaner | | Accept | 927 | 0.43 | 23.8 | 1.39 | 0.33 | 373 | 121 |
| | Total out | Accept | 10419 | 0.56 | 350.8 | | 7.68 | 455 | 2185 |
| | Diff. | In-out | 58 | | 2.7 | | 0.9 | | 1164 |
| Comer | | Rejects | 42 | 0.93 | 2.3 | 34.77 | 0.81 | 32762 | 1050 |
| 5th Stage Cleaner | | Rejects | 16 | 0.36 | 0.3 | 32.88 | 0.11 | 23680 | 113 |
| | Total | Rejects | 58 | | 2.7 | | 0.9 | | 1163 |
| | | Cleaner to Press DRE: | | | | | | 30.0% DRE | |
| Dil. Water | | Out | 10261 | 0.03 | 18.5 | | | | |
| Press | | Out | 158.5 | 35.1 | 332.4 | 1.9 | 6.3 | 318 | 1449 |
| | | Press to DIP DRE: | | | | | | 93.3% DRE | |
| DIP | | | | | | | | 21.3 | |
| PROCESS | | WASHER - DIP | | | | | | 97.0% DRE | |

30

TABLE 6

System of FIG. 3 - Multi-Stage Cleaner System with Flotation Cell on 1st Stage Rejects

SUMMARY

| | | | Flow gpm | Cons. % | STPD | Ash % | Ash STPD | Dirt > 150 ppm/1.2 g | Dirt > 150 $m^2$/day |
|---|---|---|---|---|---|---|---|---|---|
| Washer | | Thick Stock | 540 | 10.37 | 335.7 | 2.53 | 8.5 | 720 | 3310 |
| | | DWw | 4272 | 0.03 | 7.7 | 0.7 | 0.1 | 150.4 | 16 |
| Gyro | | Accept | 4812 | 1.19 | 343.4 | 2.49 | 8.5 | 708 | 3326 |
| Gyro | | Accept | 4812 | 1.19 | 343.4 | 2.49 | 8.55 | 708 | 3327 |
| Dil. Water | | | 7449 | 0.03 | 13.4 | 0.70 | 0.09 | 150 | 28 |
| | Total in | | 12261 | | 356.8 | | 8.64 | | 3355 |
| 1st Stage Cleaner | | Accept | 9492 | 0.50 | 282.9 | 2.13 | 6.04 | 443 | 1715 |
| 2nd Stage Cleaner | | Accept | 2679 | 0.42 | 67.1 | 1.12 | 0.75 | 191 | 175 |
| | Total out | Accept | 12171 | 0.48 | 350.1 | | 6.79 | 394 | 1890 |
| | Diff. | In-out | 90 | | 6.7 | | 1.85 | | 1465 |
| Comer | | Rejects | 74 | 1.45 | 6.4 | 25.91 | 1.66 | 15279 | 1337 |
| 5th Stage Cleaner | | Rejects | 16 | 0.28 | 0.3 | 69.31 | 0.19 | 34056 | 128 |
| | Total | Rejects | 89 | | 6.7 | | 1.85 | | 1465 |
| | | Cleaner to Press DRE: | | | | | | 30.0% DRE | |
| Dil. Water | | Out | 12012 | 0.03 | 21.6 | | | | |
| Press | | Out | 158.5 | 35.1 | 328.5 | 1.9 | 6.2 | 276 | 1241 |
| | | Press to DIP DRE: | | | | | | 93.3% DRE | |
| DIP | | | | | | | | 18.5 | |
| PROCESS | | WASHER - DIP | | | | | | 97.4% DRE | |

TABLE 7

System of FIG. 4 - Multi-Stage Cleaner System with Flotation on 1st St. Rejects + 3rd St. Accepts

SUMMARY

| | | | Flow gpm | Cons. % | STPD | Ash % | Ash STPD | Dirt > 150 ppm/1.2 g | Dirt > 150 $m^2$/day |
|---|---|---|---|---|---|---|---|---|---|
| | | | | | | | | Double-dirt | |
| Washer | | Thick Stock | 546 | 10.37 | 339.5 | 2.51 | 8.52 | 1489 | 6921 |
| | | DWw | 4266 | 0.015 | 3.8 | 0.7 | 0.0 | 300 | 16 |
| Gyro | | Accept | 4812 | 1.19 | 343.4 | 2.49 | 8.55 | 1476 | 6937 |
| Gyro | | Accept | 4812 | 1.19 | 343.4 | 2.49 | 8.55 | 1476 | 6937 |
| Dil. Water | | | 7543 | 0.015 | 6.8 | 0.70 | 0.05 | 300 | 28 |
| | Total in | | 12355 | | 350.1 | | 8.60 | | 6965 |
| 1st Stage Cleaner | | Accept | 10100 | 0.46 | 279.2 | 2.15 | 6.01 | 816 | 3118 |
| 2nd Stage Cleaner | | Accept | 2104 | 0.50 | 62.9 | 1.16 | 0.73 | 346 | 298 |
| | Total out | Accept | 12204 | 0.47 | 342.2 | 1.97 | 6.74 | 729 | 3416 |
| | Diff. | In-out | 151 | | 8.0 | | 1.9 | | 3549 |
| Comer | | Rejects | 143 | 0.91 | 7.8 | 23.75 | 1.85 | 31464 | 3347 |
| 5th Stage Cleaner | | Rejects | 8 | 0.41 | 0.2 | 7.68 | 0.02 | 72988 | 202 |
| | Total | Rejects | 151 | | 8.0 | | 1.9 | | 3549 |
| | | Cleaner to Press DRE: | | | | | | 30.0% DRE | |
| Dil. Water | | Out | 12045 | 0.015 | 10.8 | | | | |
| Press | | Out | 158.5 | 35.1 | 331.3 | 1.9 | 6.3 | 511 | 2316 |
| | | | | | | | | double-dirt | |
| | | Press to DIP DRE: | | | | | | 93.3% DRE | |
| DIP | | | | | | | | 34 | |
| | | | | | | | | double-dirt | |
| PROCESS | | WASHER - DIP | | | | | | 97.7% DRE | |

Note:
Mid-dirt level at the Gyro was doubled from 738 to 1476 ppm in this simulation, which results in double-dirt figures at the press and in the DIP. (Divide by 2 for comparison with simulations in Tables 4–6).

35

TABLE 8

System of FIG. 5 - Multi-Stage Cleaner System with Flotation Cell on both 1st Stage Rejects.

SUMMARY

| | | | Flow gpm | Cons. % | STPD | Ash % | Ash STPD | Dirt > 150 ppm/1.2 g | Dirt > 150 $m^2$/day |
|---|---|---|---|---|---|---|---|---|---|
| | | | | | | | | double-dirt | |
| Washer | | Thick Stock | 546 | 10.37 | 339.5 | 2.51 | 8.5 | 1489 | 6920 |
| | | DWw | 4266 | 0.015 | 3.8 | 0.7 | 0.0 | 300 | 16 |
| Gyro | | Accept | 4812 | 1.19 | 343.3 | 2.49 | 8.5 | 1476 | 6935 |
| Gyro | | Accept | 4812 | 1.19 | 343.4 | 2.49 | 8.55 | 1476 | 6937 |
| Dil. Water | | | 7431 | 0.015 | 6.7 | 0.70 | 0.05 | 300 | 27 |
| | Total in | | 12243 | | 350.0 | | 8.60 | | 6964 |
| 1st Stage Cleaner | | Accept | 8417 | 0.44 | 223.0 | 1.89 | 4.21 | 523 | 1596 |
| 2nd Stage Cleaner | | Accept | 3619 | 0.53 | 115.3 | 1.36 | 1.56 | 388 | 612 |
| | Total out | Accept | 12036 | 0.47 | 338.3 | | 5.77 | 477 | 2208 |
| | | | 12036 | 0.55 | 400.0 | | | | |
| | Diff. | In-out | 208 | | 11.8 | | 2.8 | | 4756 |
| Comer | | Rejects | 192 | 0.99 | 11.4 | 24.65 | 2.81 | 28167 | 4389 |
| 5th Stage Cleaner | | Rejects | 16 | 0.39 | 0.4 | 8.54 | 0.03 | 71490 | 367 |
| | Total | Rejects | 208 | | 11.8 | | 2.8 | | 4756 |
| | | Cleaner to Press DRE: | | | | | | 30.0% DRE | |
| Dil. Water | | Out | 11856 | 0.015 | 10.7 | 0.70 | 0.1 | | |
| Press | | Out | 180.0 | 35.16 | 327.6 | 1.74 | 5.7 | 334 | 1497 |
| | | | | | 379.5 | | | double-dirt | |
| | | Press to DIP DRE: | | | | | | 93.3% DRE | |

TABLE 8-continued

System of FIG. 5 - Multi-Stage Cleaner System with Flotation Cell on both 1st Stage Rejects.

SUMMARY

| | | Flow gpm | Cons. % | STPD | Ash % | Ash STPD | Dirt > 150 ppm/1.2 g | Dirt > 150 $m^2$/day |
|---|---|---|---|---|---|---|---|---|
| DIP | | | | | | | 22 double-dirt | |
| PROCESS | WASHER - DIP | | | | | | 98.5% DRE | |

Note:
Mid-dirt level at the Gyro was doubled from 738 to 1476 ppm in this simulation, which results in double-dirt figures at the press and in the DIP. (Divide by 2 for comparison with simulations in Tables 4–6).

What is claimed is:

1. A method of processing papermaking fibers with a multistage array of forward cleaners including a plurality of centrifugal cleaners configured to generate accepts streams and rejects streams which concentrate heavy waste, said method comprising:

(a) feeding a first aqueous feed stream including papermaking fibers to a first stage bank of centrifugal cleaners of said multistage array;

(b) generating a first accepts aqueous stream and a first rejects aqueous stream in said first stage bank of centrifugal cleaners, said first aqueous rejects stream being enriched in heavy waste with respect to said first aqueous feed stream;

(c) supplying said first rejects aqueous stream to a flotation stage;

(d) treating said first rejects aqueous stream in said flotation stage to remove hydrophobic waste from said first aqueous rejects stream and produce an intermediate aqueous purified feed stream; and (e) feeding said aqueous purified intermediate feed stream to a second stage bank of centrifugal cleaners of said multistage array, said second stage bank of centrifugal cleaners being configured to generate a second accepts aqueous stream and a second rejects aqueous stream, wherein said second rejects aqueous stream is enriched in heavy waste with respect to said aqueous purified intermediate feed stream.

2. The method according to claim 1, further comprising feeding said first accepts aqueous stream and said second accepts aqueous stream to another cleaning device or a thickening device.

3. The method according to claim 1, wherein said first aqueous feed stream comprises a preliminary accepts stream generated by way of a preliminary bank of centrifugal cleaners dividing a preliminary feed stream into a preliminary accepts stream and a preliminary rejects stream.

4. The method according to claim 3, further comprising feeding said preliminary rejects stream to said flotation stage and treating said preliminary rejects stream along with said first rejects aqueous stream to remove hydrophobic waste therefrom whereby said aqueous purified intermediate stream includes treated components from both the preliminary rejects stream and said first rejects aqueous stream.

5. The method according to claim 1, further comprising feeding said first accepts aqueous stream to another cleaning device or a thickening device.

6. The method according to claim 1, further comprising feeding said second accepts aqueous stream to another cleaning device or a thickening device.

7. The method according to claim 1, further comprising feeding said second rejects aqueous stream to a third centrifugal cleaner operative to generate a third accepts aqueous stream and a third rejects aqueous stream.

8. The method according to claim 1, wherein said multistage array of forward cleaners comprises at least 3 banks of centrifugal cleaners.

9. The method according to claim 8, wherein said multistage array of forward cleaners comprises at least 5 banks of centrifugal cleaners.

10. The method according to claim 1, wherein said first aqueous feed stream has a consistency of from about 0.3% to about 0.9%.

11. The method according to claim 1, wherein said first aqueous stream has a consistency of from about 0.4% to about 0.7%.

12. The method according to claim 1, wherein the hydrophobic waste removed from said first aqueous rejects stream by said flotation stage includes an ink composition.

13. The method according to claim 1, wherein said ink composition is a toner ink composition.

14. The method according to claim 1, wherein the hydrophobic waste removed from said first aqueous rejects stream by said flotation stage comprises stickies.

15. The method according to claim 14, wherein the hydrophobic waste removed from said first aqueous rejects stream by said flotation stage comprises an ink composition and stickies.

16. The method according to claim 15, wherein said ink composition comprises a toner ink composition and said stickies comprise stickies derived from pressure sensitive adhesives.

17. In a method for processing papermaking fibers including a multistage array of forward cleaners comprising a plurality of centrifugal cleaners configured to generate accepts streams and rejects streams which concentrate heavy hydrophobic waste, the rejects stream of at least one cleaner being fed to another centrifugal cleaner, the improvement comprising processing at least one rejects stream of a centrifugal cleaner of said multistage array with a flotation stage to remove hydrophobic waste, said flotation stage thereby generating an intermediate purified stream, wherein said improvement further comprises feeding said intermediate purified stream to a second bank of centrifugal cleaners of said multistage array.

18. The improvement according to claim 17, wherein said second bank of centrifugal cleaners is configured to generate a second accepts stream and a second rejects stream which concentrates waste with respect to the feed of said cleaner and further comprising feeding said second accepts stream to another cleaning device or a thickening device.

* * * * *